United States Patent [19]

Gaudish

[11] 4,053,103

[45] Oct. 11, 1977

[54] HERMETICALLY SEALED CARTON

[75] Inventor: Paul Gaudish, Mundelein, Ill.

[73] Assignee: International Paper Company, New York, N.Y.

[21] Appl. No.: 725,897

[22] Filed: Sept. 22, 1976

[51] Int. Cl.[2] ..... B65D 5/02

[52] U.S. Cl. ..... 229/37 R

[58] Field of Search ..... 229/37, 38, 17 G

[56] References Cited

U.S. PATENT DOCUMENTS

| | | | |
|---|---|---|---|
| 2,737,335 | 3/1956 | Moore | 229/37 R X |
| 2,769,589 | 11/1956 | Moore | 229/37 R |
| 3,229,890 | 1/1966 | Wright | 229/37 R |
| 3,746,244 | 7/1973 | Bergstein | 229/37 R |
| 3,892,349 | 7/1975 | Persson | 229/37 R |
| 4,003,467 | 1/1977 | Focke et al. | 229/37 R X |

FOREIGN PATENT DOCUMENTS

| | | | |
|---|---|---|---|
| 1,247,747 | 10/1960 | France | 229/37 R |

*Primary Examiner*—Davis T. Moorhead

*Attorney, Agent, or Firm*—Jay S. Cinamon

[57] ABSTRACT

In accordance with the present invention a paperboard container is provided with a hermetic end closure. The manufacturers flap, which is of unique construction, is foldably connected to an adjacent ungussetted panel. During the folding sequence, the manufacturers flap is sealed to a gussetted panel and the gussets at either end of the container are then caused to be moved outwardly to form projecting wings, and then the inner surfaces of the rib panels are brought into juxtaposed alignment for sealing engagement to form a continuous and uninterrupted hermetic closure.

6 Claims, 18 Drawing Figures

FIG. 2
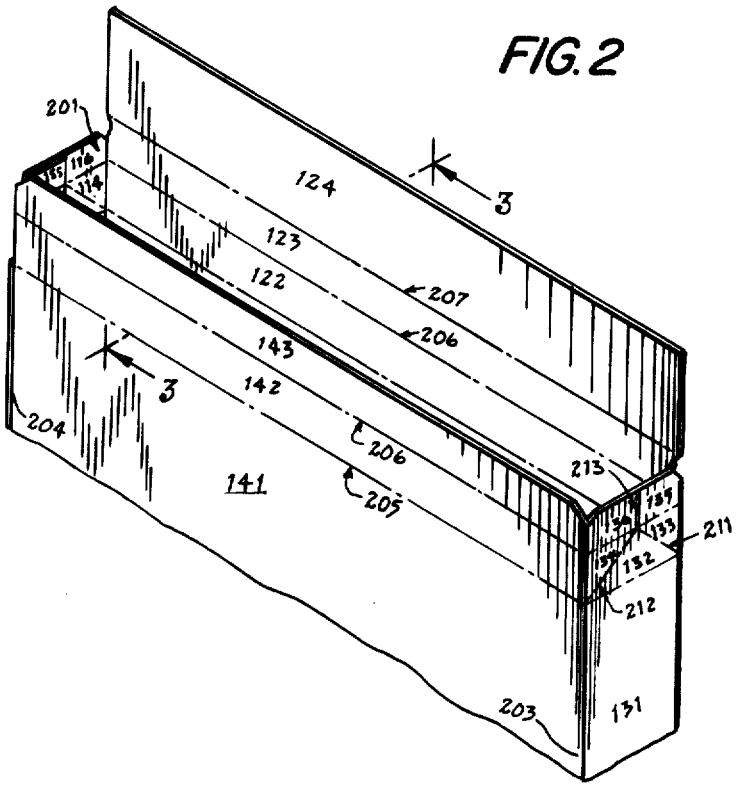
FIG. 3
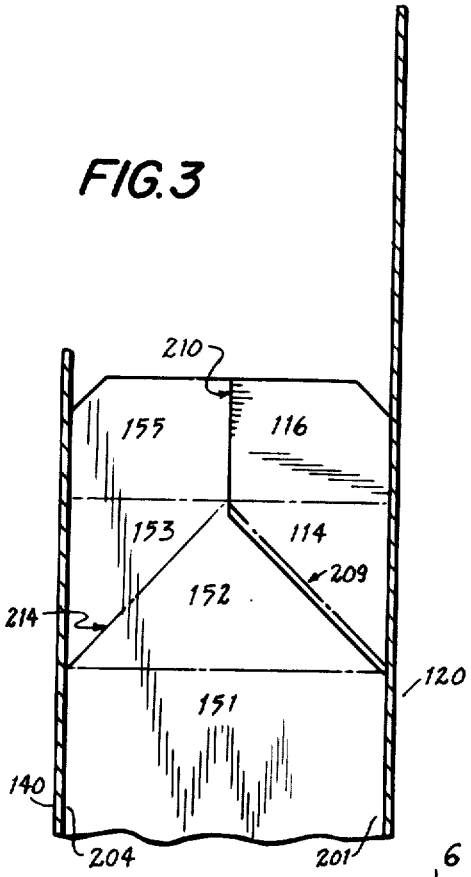
FIG. 4
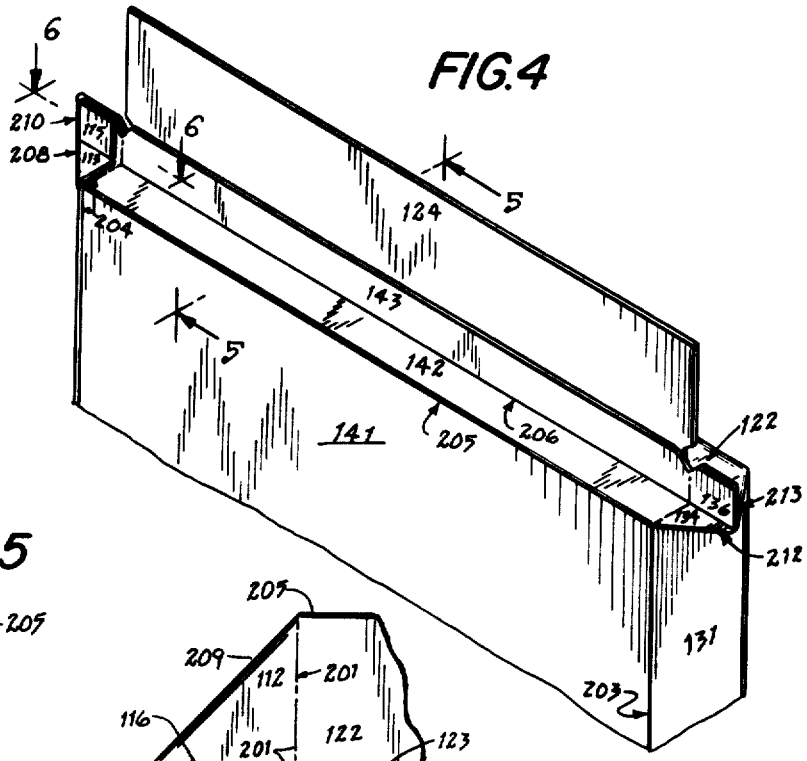
FIG. 5
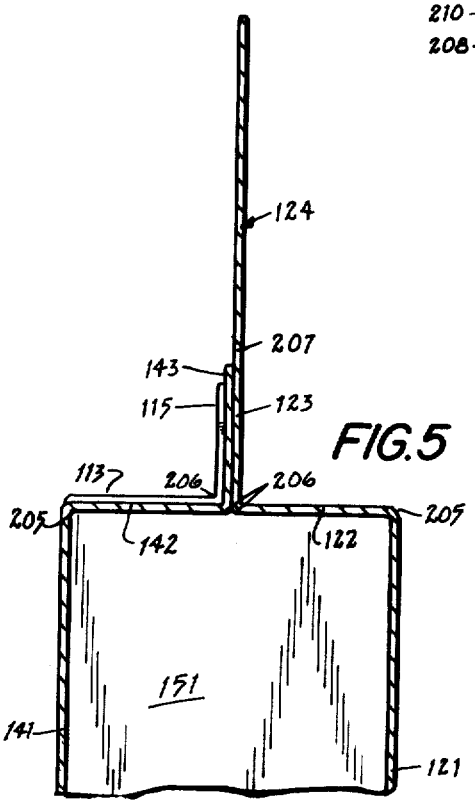
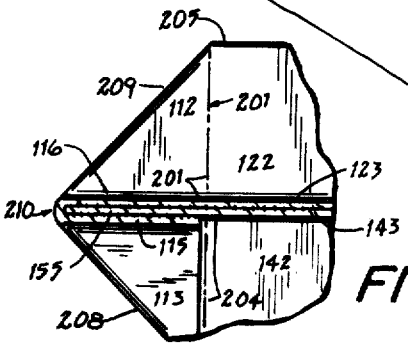
FIG. 6

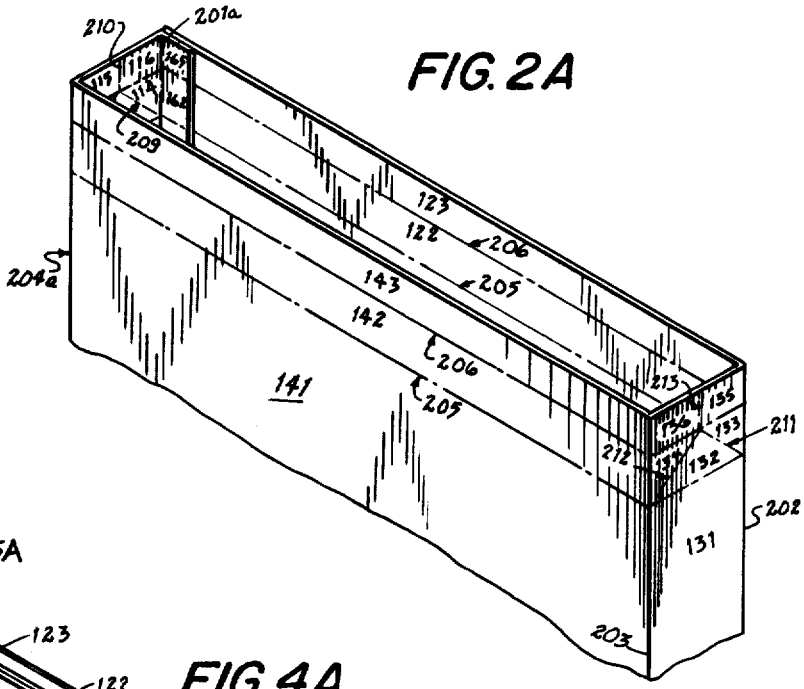
FIG. 2A
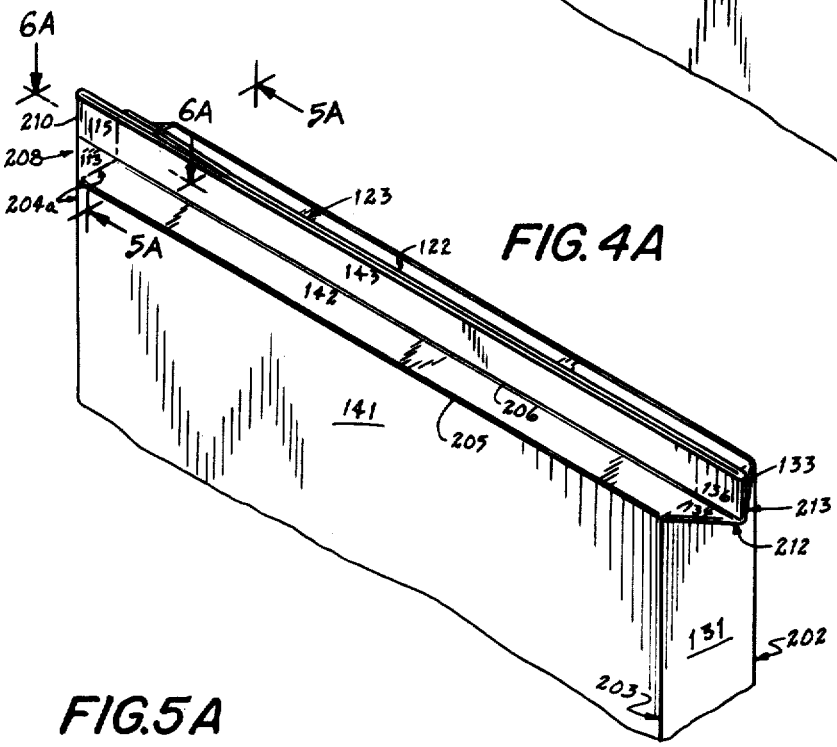
FIG. 4A
FIG. 5A
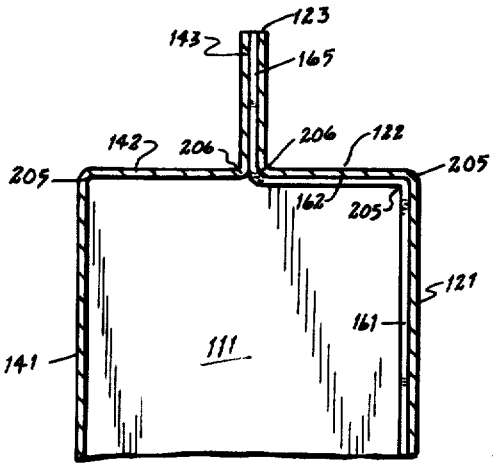
FIG. 6A
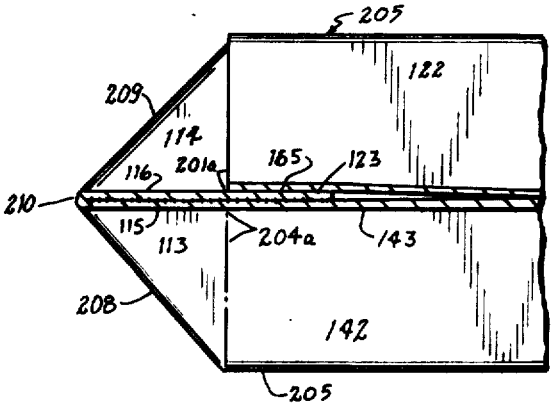

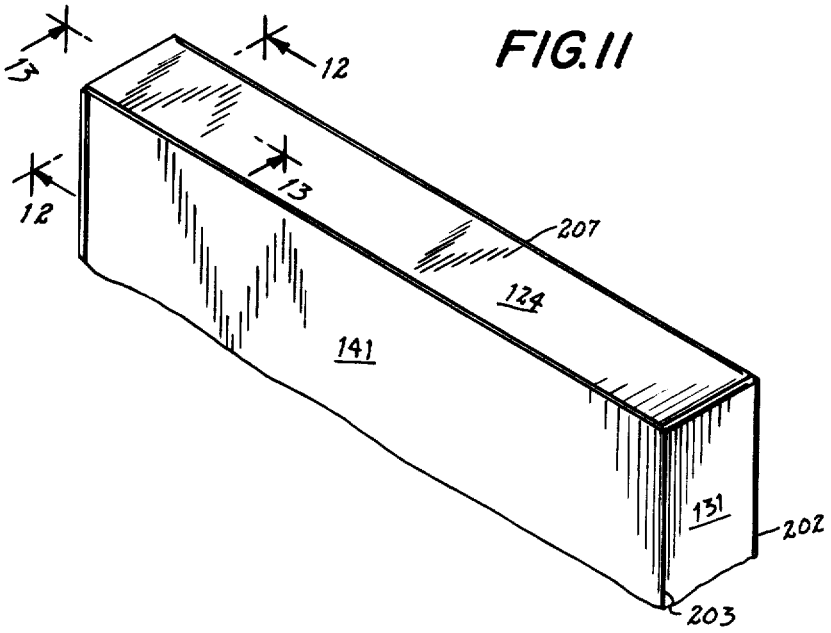
FIG. 11
FIG. 12
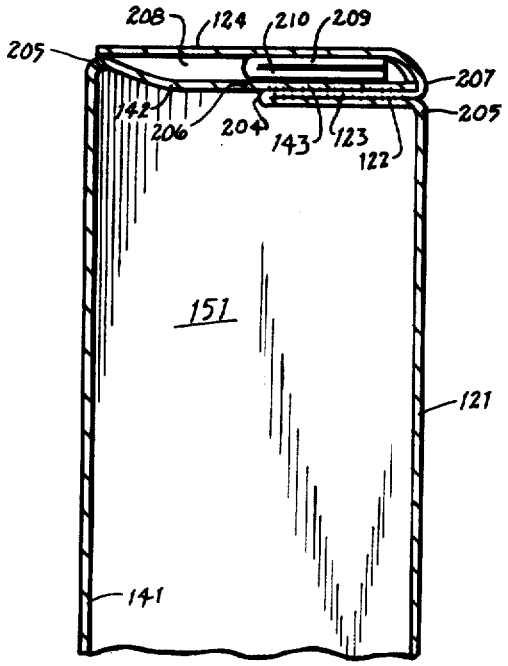
FIG. 13
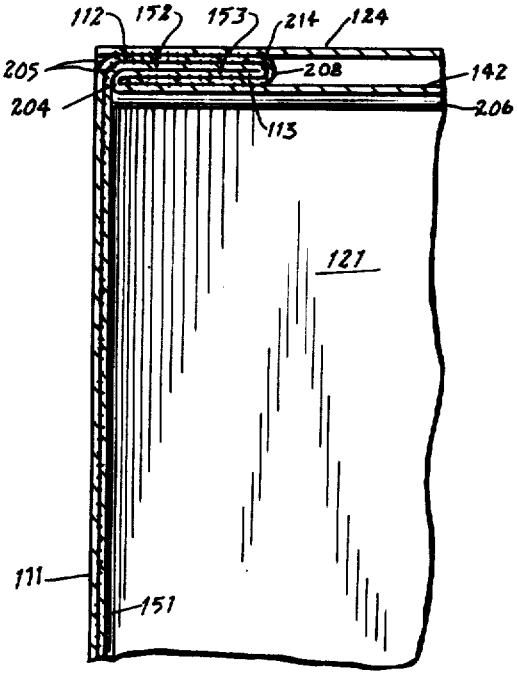

HERMETICALLY SEALED CARTON

BACKGROUND OF THE INVENTION

This invention relates to paperboard containers in general, and in particular to an improved hermetic closure for paperboard containers.

Paperboard containers are now being used to package a wide variety of organic products, especially processed foods. These containers must be siftproof, stackable, and resistant to air, liquids, and insect infestation. Packages which are to be sold in supermarkets should also be sturdy and pilfer-proof, and have a relatively long shelf life.

The packages most commonly used to meet these requirements have been multi-layer containers consisting of a paperboard box and a flexible sheet of hermetically sealable material. The flexible sheet has been used either as a liner for the box, as in French Pat. No. 1,247,747, or as an overwrap for it. Single-layer coated paperboard containers, though less expensive and easier to manufacture, are seldom seen outside the dairy case due to the difficulty of making a closure which is both hermetic and flat enough to be stackable.

It is therefore an object of the present invention to provide a hermetic closure for a paperboard container.

It is another object of the present invention to provide a novel low-cost paperboard container which is siftproof, pilfer-proof, air resistant, durable and resistant to infestation by insects.

It is yet another object of the present invention to provide a paperboard container with a long shelf life and superior stacking strength.

BRIEF DESCRIPTION OF THE DRAWINGS

These and other objects and advantages of the present invention will be fully understood from the following description when taken in conjunction with the accompanying drawings, in which:

FIG. 2A is a partial perspective view of the first step in the folding sequence for the prior art container.

FIG. 2 is a partial perspective view of the first step in the folding sequence for the subject invention.

FIG. 3 is a cross-sectional view taken along the line 3—3 in FIG. 2.

FIG. 4A is a partial perspective view of the second step in the folding sequence for the prior art container.

FIG. 4 is a partial perspective view of the second step in the folding sequence for the subject invention.

FIG. 5A is a cross-sectional view taken along the line 5A—5A in FIG. 4A.

FIG. 5 is a cross-sectional view taken along the line 5—5 in FIG. 4.

FIG. 6A is a cross-sectional view taken along the line 6A—6A in FIG. 4A.

FIG. 6 is a cross-sectional view taken along the line 6—6 in FIG. 4, and particularly pointing out the novel seal effected by the present invention.

FIG. 11 is a partial perspective view of the final step in the folding sequence for the subject invention.

FIG. 12 is a cross-sectional view taken along the line 12—12 in FIG. 11.

FIG. 13 is a cross-sectional view taken along the line 13—13 in FIG. 11.

SUMMARY OF THE INVENTION

In accordance with the present invention a paperboard container is provided with a hermetic end closure. The manufacturers flap, which is of unique construction, is foldably connected to an adjacent ungussetted panel. During the folding sequence, the manufacturers flap is sealed to a gussetted panel and the gussets at either end of the container are then caused to be moved outwardly to form projecting wings, and then the inner surfaces of the rib panels are brought into juxtaposed alignment for sealing engagement to form a continuous and uninterrupted hermetic closure.

DETAILED DESCRIPTION OF THE INVENTION

Figure 1:
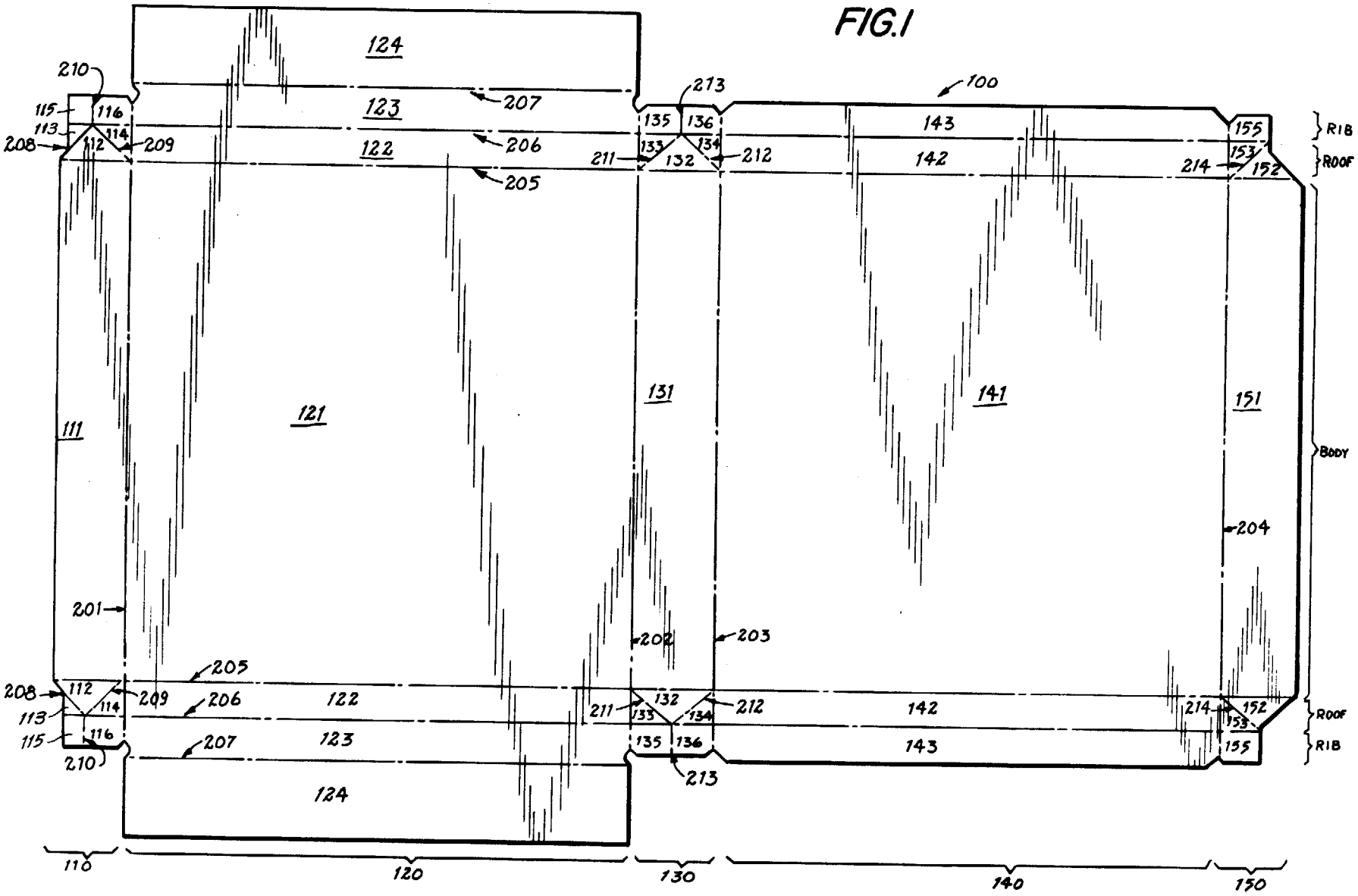
FIG. 1 is a plan view of the container blank of the preferred embodiment of the present invention.
Figure 1A:
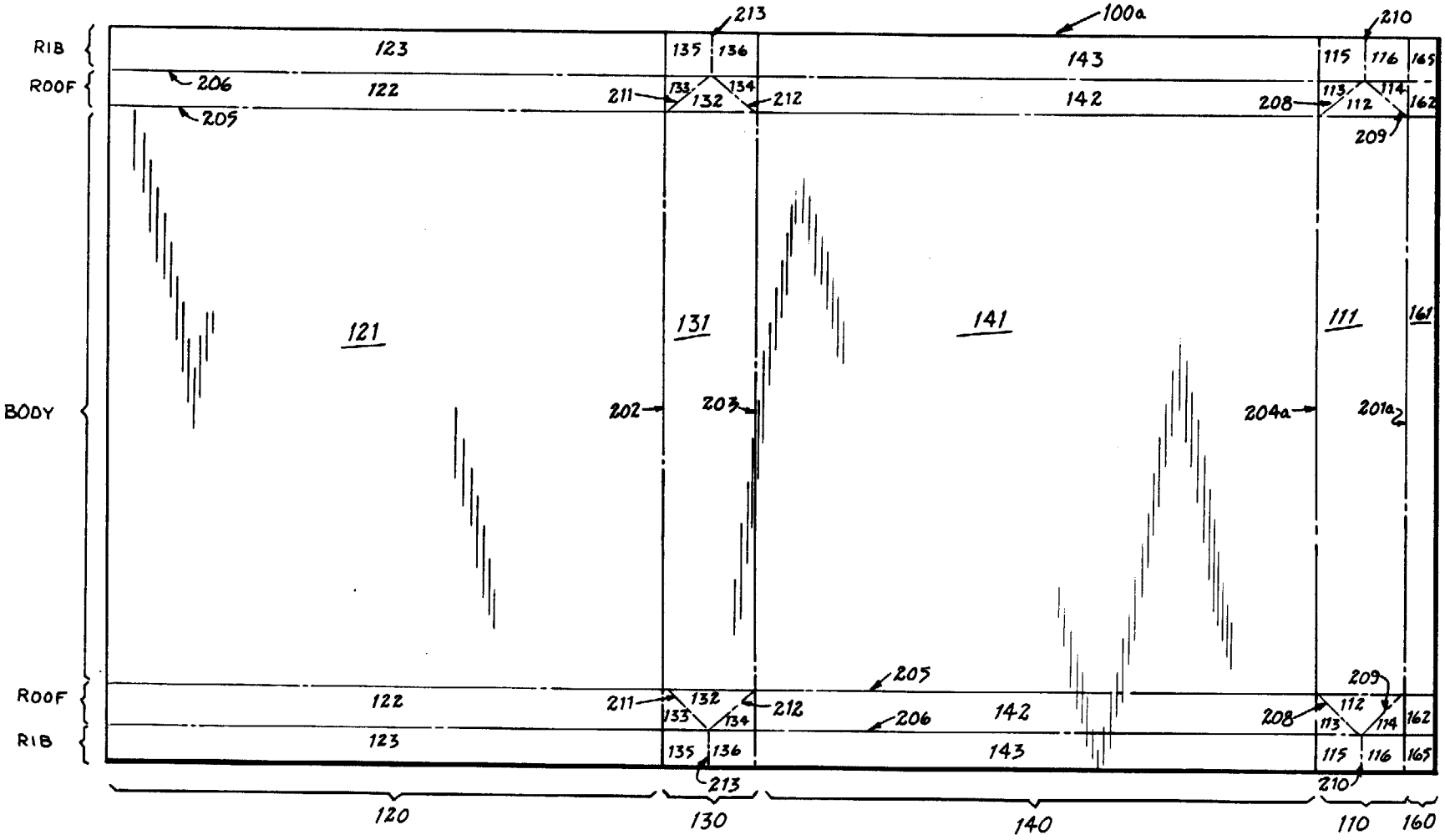
FIG. 1A PRIOR ART
FIG. 1A is a plan view of a prior art container blank.

Referring now to the drawings, wherein like reference characters designate like parts throughout the several views, there is shown in FIG. 1A a prior art blank for a container having gable-top clsoures at both ends. Since the two end closures are identical, only one will be described in detail; the description applying equally to either end. The blank, 100*a*, is vertically divided by score lines 202, 203, 204*a*, 201*a*, into four side panels 120, 130, 140, 110, alternately gussetted and ungussetted, and a manufacturers flap 160. Each of these five panels is further divided by horizontal score lines 205 and 206 into the familiar body, roof, and rib sections of a gable-top blank. Thus, gussetted panel 110 consists of a body panel 111, a roof section consisting of triangular end panel 112 attached to a triangular foldout panels 113 and 114 along diagonal score lines 208 and 209, and a rib section comprising rib panels 115 and 116 joined along short vertical score line 210. Similarly, gussetted panel 130 consists of a body panel 131, a triangular end panel 132 joined to triangular foldout panels 133 and 134 along diagonal score lines 211 and 212, and rib panels 135 and 136 joined along score line 213. Ungussetted panel 120 consists of body panel 121, roof panel 122, and rib panel 123, while ungussetted panel 140 consists of body panel 141, roof panel 142, and rib panel 143. In much the same manner, the manufacturers flap 160 consists of a side sealing flap 161, a side roof flap 162, and a side rib flap 165.

Before proceeding with a description of the blank of the present invention, it should be noted that the conventional practice in the prior art was, and still is, to make the manufacturers flap as narrow as possible in order to conserve material. Also, the manufacturers flap is almost always attached to a gussetted panel so that fewer score lines are required on the side roof and rib flaps. This prior art practice is readily seen by refering to FIG. 1A, wherein manufacturers flap 160 is depicted as being relatively narrow with respect to panels 110 and 130.

FIG. 1 depicts a container blank 100 modified in accordance with the present invention. Since the two end closures are identical, only one end thereof will be described in detail, it being understood that the description applies equally to either end.

Gussetted panel 110 consists of first body panel 111 and attached thereto along horizontal score line 205 is a roof section consisting of first triangular end panel 112 attached to a first pair of triangular fold-out panels 113 and 114 along diagonal score lines 208 and 209. Surmounting panels 113 and 114, and extending therefrom along horizontal score line 206, are first and second rib panels 115 and 116, respectively, which are joined together along vertical fold line 210.

Gussetted panel 110 is foldably connected to ungussetted panel 120 along vertical score line 201. Panel 120 consists of second body panel 121 which is connected to a first roof panel 122 along horizontal score line 205. Roof panel 122 is connected to third rib panel 123 along horizontal score line 206.

Gussetted panel 130 is foldably connected to ungussetted panel 120 along vertical score line 202. Panel 130 consists of third body panel 131 and attached thereto along horizontal score line 205 is a roof section consisting of second triangular end panel 132 attached to a second pair of triangular fold-out panels 133 and 134 along diagonal score lines 211 and 212. Surmounting panels 133 and 134, and extending therefrom along horizontal score line 206, are fourth and fifth rib panels 135 and 136, respectively, which are joined together along vertical fold line 213.

Ungussetted panel 140 is foldably connected along vertical score line 203 to panel 130. Panel 140 consists of a fourth body panel 141 and foldably connected thereto along horizontal score 205 is a second roof panel 142. Roof panel 142 is foldably connected to sixth rib panel 143 along horizontal score line 206.

Manufacturers flap 150 is foldably connected to ungussetted panel 140 along vertical fold line 204. Flap 150 consists of side sealing flap 151 which is foldably connected to a side roof flap, consisting of triangular end panel 152 and triangular foldout panel 153 joined along diagonal score line 214. Side rib panel 155, which is the seventh rib panel, is foldably connected to panel 153 along horizontal score line 206.

In accordance with the present invention, manufacturers flap 150, as shown in FIG. 1, is foldably connected to ungussetted panel 140 along score line 204. The width of seventh rib panel 155 is substantially equal to one-half the width of body panel 131, while side sealing flap 151 has the same dimensions as body panel 131. In an alternate embodiment, the width of manufacturers flap 150 can be substantially equal to one-half of the width of body panel 131, along its entire length, without adversely affecting the cartons construction or the ease of folding. When this alternative manufacturers flap construction is employed in the asceptic packaging of sterile milk, for example, it is preferred to skive the manufacturers flap in accordance with Haas et al., U.S. Pat. No. 3,495,507. It is apparent, that the dimensions of side rib panel 155 would be unaffected by halving the width of the manufacturers flap 150. It is the placement of the manufacturers flap and the dimensions of its side rib flap, which when combined with the folding sequence hereinafter described, serve to produce the improved hermetic seal of the subject invention.

Blank 100 also differs from blank **100*a* in that the former has an additional panel, cover panel 124, attached along horizontal score line 207 to a rib panel selected from the group consisting of third rib panel 123 and sixth rib panel 143. In the illustrated embodiment, the cover panel 124 is attached to rib panel 123. Alternatively, cover panel 124 could be selected for attachment to rib panel 143** without affecting the invention. As will be shown later, the cover panel provides a flat, attractive closure, and greatly increases the stacking strength of the finished container.

FIGS. 2 and 2A show the partially assembled boxes formed in the first step of the folding sequence from the blank of FIGS. 1 and 1A, respectively. In FIG. 2A, blank **100*a* is folded along score lines 201*a*, 202, 203, 204*a* to form a tube, with the outer surface of manufacturers flap 160 being heat-sealed to the inner surface of ungussetted panel 120**.

In FIG. 2, blank 100 is folded along score lines 201, 202, 203, 204 to form a substantially rectangular tube, and the outer surface of manufacturers flap 150 is heat-sealed to the inner surface of gussetted panel 110.

FIG. 3 is an interior view of the tube, taken along the line 3—3 in FIG. 2, which shows more clearly the placement of manufacturers flap 150. As is indicated in FIG. 3, side sealing flap 151 completely overlies body panel 111, so that the free edge of flap 151 lies in the score line 201. Panels 152 and 153 overlie panels 112 and 113, respectively, but as shown in FIG. 3, the preferred embodiment, triangular end panel 152 is slightly smaller than triangular end panel 112, which it overlies, so that score line 209 is not covered. This facilitates folding during later stages of the sequence. Since the width of seventh rib panel 155, is slightly greater than first rib panel 115, it completely covers rib panel 115 and the free edge of 155 lies in score line 210.

FIG. 4A shows the second stage in the prior art folding sequence. Rib panels 115 and 116 are pinched together and outward along line 210, while rib panels 135 and 136 are pinched outward along line 213. Roof panels 122 and 142 are folded in along score line 205 to form a roof for the container. Triangular end panel 112 extends out beyond the side of the box, and panels 113 and 114 fold down along score lines 208 and 209 to overlie it, forming a projecting wing. In like manner, panels 132, 133 and 134 form a projecting wing with edges defined by lines 211 and 212. Finally rib panels 123 and 143, 115 and 116, 135 and 136 are juxtaposed in paired relationship and heat-sealed together to form an upstanding rib.

FIG. 5A shows the disposition of the manufacturers flap after the second step in the folding sequence. Since flap 160 has been affixed to an ungussetted panel, the two are folded as one. Side roof flap 162 is infolded along with roof panel 122, and side rib flap 165 is trapped between panels 123 and 143.

While bonding of the rib panels is intended to form a continuous hermetic closure, an inspection of FIG. 6A reveals that the placement of side rib panel 165 creates a gap in the seal. By the application of tremendous heat and pressure, panels 123 and 143 can be bonded along their entire lengths, but panels 165 will, nonetheless, continue to exert a separating force that will eventually cause the seal to rupture. Thus, a closure formed in accordance with the prior art has, at best, a brief and uncertain duration. The gap in the seal and the attendant problems arising therefrom are apparent from a careful examination of French Pat. No. 1,247,747, which represents the deficiencies in hermetic closures of the prior art, which this invention overcomes.

FIG. 4 illustrates the second step in the folding sequence as it is applied to the container blank of the present invention. Panels 112, 113 and 114, which together form a gusset, are pinched together, and panels 132, 133 and 134, which together also form a gusset, are pinched together, to form a pair of projecting wings which extend outwardly beyond the perimeter of the container, while roof panels 132 and 142 are folded along line 205 to form a roof. The rib panels are then brought into juxtaposed paired alignment for sealing. Second rib panel 116 is sealed to seventh rib panel 155, third rib panel 123 is sealed to sixth rib panel 143, and fourth rib panel 135 is sealed to fifth rib panel 136, thus forming a continuous and uninterrupted upstanding multi-ply rib which provides a hermetic closure extending the width of the container. In the present invention, however, as is shown most clearly in FIG. 3, in contrast to the prior art, the seventh rib panel 155 lies between panels 115 and 116 with its free edge in score line 210 at the extreme end of the rib. The raw edge of rib panel 115, as can be seen in FIG. 5, is on the outside of the container.

As FIG. 6 clearly indicates, the rib panels are positioned in such a manner that no disruptive forces are acting upon the seal. Consequently, a complete and long-lasting hermetic closure is easily and readily formed and maintained.

In the preferred embodiment, a flat roof with a central upstanding rib is obtained by making the height of roof panels 122 and 142 one-half the width of the gusseted body panels 111 and 131. For certain purposes, e.g., to conserve materials in a substantially cubical container or to form a peaked roof, it may be desirable to vary the heights of panels 122 and 142. Such variations do not impair the effectiveness of the seal and are included within the scope of the invention.

Figure 7:
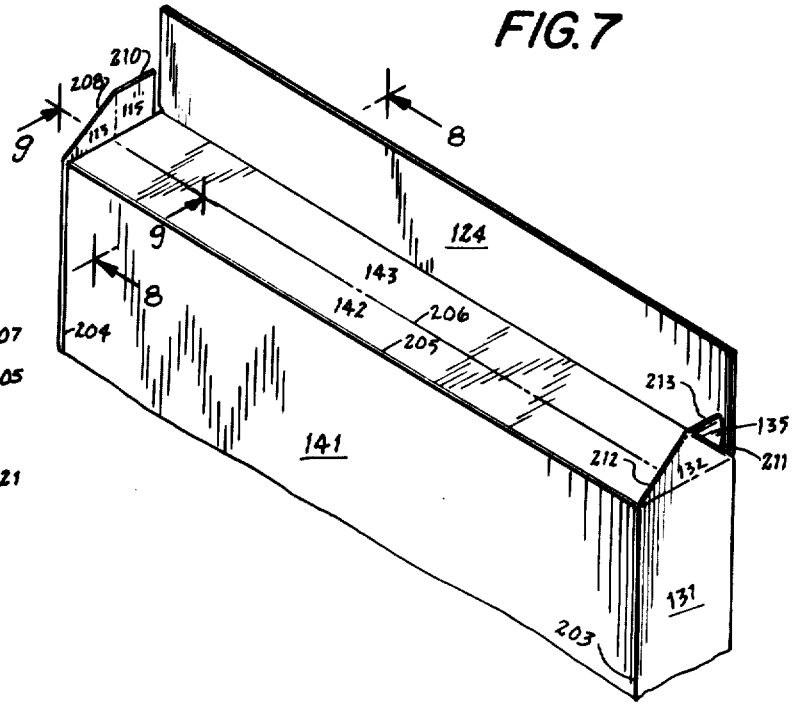
FIG. 7 is a partial perspective view of the third step in the folding sequence for the subject invention.

FIG. 7 illustrates the third step in the folding sequence of the present invention. Either the third rib panel 123 or the sixth rib panel 143, which are sealed together to form the central portion of the upstanding multi-ply rib, is then selected and folded at right angles about score line 206 to overlie in a substantially flat relationship, either roof panel 122 or roof panel 142, depending upon whether the third or sixth rib panel is selected. As depicted in FIG. 7, rib panel 123 is folded substantially normal to its prior upstanding position to overlie in substantially flattened relationship roof panel 122 to which it is then sealed. The projecting wings are then folded upwardly and cover panel 124 is also folded upwardly.

Figure 8:
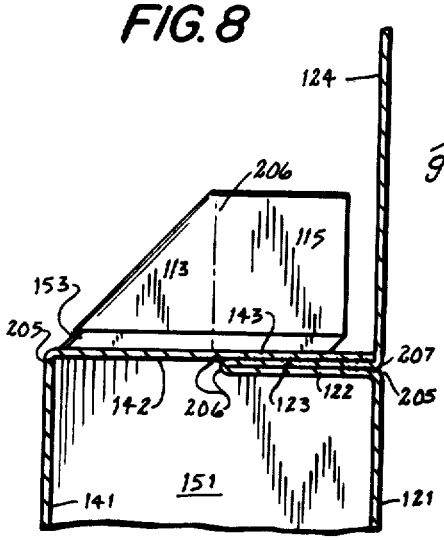
FIG. 8 is a cross-sectional view taken along the line 8—8 in FIG. 7.
Figure 9:
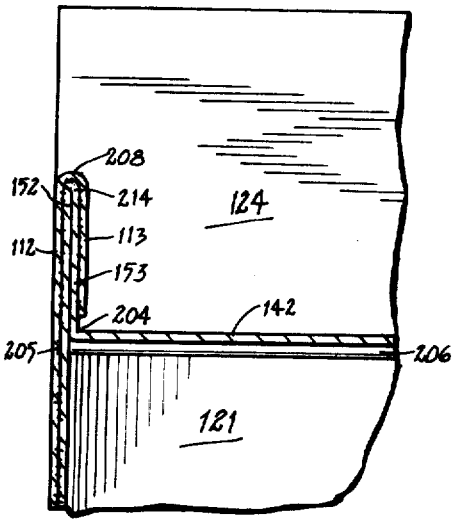
FIG. 9 is a cross-sectional view taken along the line 9—9 in FIG. 7.

The seven rib panels, as pictured, are all the same height. This feature, while desirable, is not necessary to the invention. It is necessary, though, that the selected rib panel, either 123 or 143, be the same height as roof panel 122 or 142, so that, at the completion of the third step in the folding sequence, score line 207 lies along an outside edge of the box. FIGS. 8 and 9 are cutaway views showing more clearly the disposition of the various panels at this stage.

Figure 10:
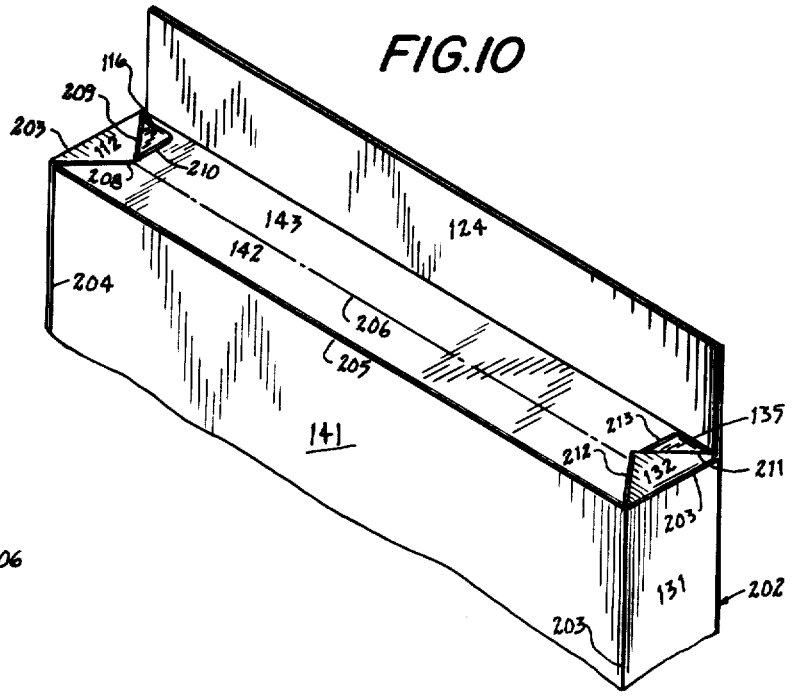
FIG. 10 is a partial perspective view of the fourth step in the folding sequence for the subject invention.

FIG. 10 shows the fourth step in the folding sequence. The projecting wings, shown as upstanding in FIG. 7, are now folded inwardly and downwardly at right angles resulting in rib panel 115 of one wing and 136 of the other wing being sealed to and overlying flattened rib panel 143, whereby a substantially flat closure is formed. Panels 142 and 143 will buckle inwardly slightly to accommodate the wings.

FIG. 11 shows the fifth and final step in the novel folding sequence of the subject invention. Cover panel 124 is folded down along score line 207 and over said flattened rib panels and sealed to roof panel 142 to cover the entire top of the container. Thus, a flat and seamless covering is provided for the closure. The coverting panel also protects the hermetic seal underneath from pilferage and breakage during handling.

Cross-sectional views 12 and 13 show the disposition of the various panels beneath the cover in the finished container. As they indicate, the novel closure herein presented leaves no raw edges on the inside of the container. Furthermore, the triangular wings reinforce the corners of the box, making them virtually uncrushable, and giving the container, as a whole, exceptional stacking strength.

The subject container can be made of paperboard coated on one or both sides with a thermoplastic substance, such as polyethylene. Alternatively, the container can be made of uncoated paperboard having applied thereto a heat-sealable material arranged in a particularized pattern to conform with the folding sequence described herein, in order to effect a hermetic seal.

Although no opening feature is shown, any opening suitable for a hermetic package, such as a tear strip or a single-severable score line, could be employed. The dimensions of the container may be varied to suit the product, and the shape of the manufacturers flap (excluding its rib portion) adapted accordingly. Other modifications will occur to those skilled in the art, and while one embodiment has been discussed in detail, it is not intended that the invention be limited to that embodiment.

The terms and expressions that have been employed herein are used as terms of description and not of limitation, and there is no intention in the use of such terms and expressions to exclude any equivalents of the features shown and described or portions thereof, but it is recognized that various adaptations are possible within the scope of the invention as claimed.

What is claimed is:

1. A container closure, including:

a. a body portion comprising first, second, third and fourth foldably connected body panels, and a sealing flap foldably connected to said fourth body panel, the outer surface of said sealing flap being sealed to the inner surface of said first body panel;

b. said closure having first and second triangular end panels foldably connected to said first and third body panels as extensions thereof, and first and second roof panels foldably connected to said second and fourth body panels as extensions thereof;

c. said first triangular end panel connected to said first and second roof panels by a first pair of triangular fold-out panels extending therefrom;

d. said second triangular end panel connected to said first and second roof panels by a second pair of triangular fold-out panels extending therefrom;

e. said closure also having a side roof flap foldably connected to said sealing flap, the outer surface of said side roof flap being sealed to the inner surfaces of the extensions of said first body panel;

f. said first pair of triangular fold-out panels having first and second rib panels foldably connected thereto;

g. said first roof panel having a third rib panel foldably connected thereto;

h. said second pair of triangular fold-out panels having fourth and fifth rib panels foldably connected thereto;

i. said second roof panel having a sixth rib panel foldably connected thereto;

j. said side roof flap having a seventh rib panel foldably connected thereto;

k. consecutively numbered rib panels being foldably connected to one another, and the outer surface of said seventh rib panel being sealed to the inner surface of said first rib panel;

l. said roof panels extending across an end of said body portion;

m. said triangular end panels extending outward beyond said body to form projecting wings;

n. said triangular fold-out panels overlying said triangular end panels;

o. the inner surfaces of said second, third and fourth rib panels being sealed to the inner surfaces of said seventh, sixth, and fifth rib panels, respectively;

whereby a continuous and uninterrupted hermetic closure extending the width of the container is formed.

2. The closure according to claim 1 wherein a. the height of each of said roof panels is subtantially one-half the width of each of said first and third body panels, whereby said roof panels form a substantially flat roof; and b. the height of a rib panel selected from the group consisting of said third and sixth rib panels is substantially equal to the height of each of said roof panels, said selected rib panel being folded substantially normal to its previous position so that said selected rib panel lies in a substantially flattened overlying relationship with respect to one of said roof panels, and said projecting wings being folded and sealed in an overlying relationship to said now flattened selected rib panel, whereby a substantially flat closure is formed.

3. The clsoure according to claim 2 wherein said selected rib panel is sealed in an overlying relationship with the roof panel foldably connected thereto, and wherein said closure further comprises a covering panel attached to said selected rib panel as an extension thereof, said covering panel being folded across and over said flattened rib panels and sealed to the other of said roof panels, whereby a flat and seamless covering for said closure is formed.

4. A container having closures as described in claim 1 at both ends.

5. A container having closures as described in claim 3 at both ends.

6. A blank for a hermetically sealable paperboard container, said blank comprising, in combination, a. first, second, third and fourth body panels;

b. a triangular end panel foldably connected to each end of said first and third body panels as an extension thereof;

c. a roof panel foldably connected to each end of said second and fouth body panels as an extension thereof, the height of each roof panel being substantially one-half the width of said first and third body panels;

d. a pair of triangular fold-out panels flanking each of said triangular end panels, said triangular fold-out panels connecting said triangular end panels with said roof panels;

e. a pair of first rib panels foldably connected to each of said pairs of triangular foldout panels and extending therefrom;

f. a second rib panel foldably connected to each of said roof panels as an extension thereof;

g. a side sealing flap, having substantially the same dimensions as each of said first and third body panels, foldably connected to said fourth body panel;

h. a side roof flap, consisting of a triangular end panel and a triangular fold out panel, foldably connected to each end of said side sealing flap as an extension thereof, the height of each of said side roof flaps being substantially equal to the height of each of the side roof panels; and i. a side rib panel foldably connected to each of said side roof flaps as an extension thereof, said side rib panels having substantially the same dimensions as said first rib panels.

* * * * *